US005659659A

United States Patent [19]

Kolesnik et al.

[11] Patent Number: 5,659,659

[45] Date of Patent: Aug. 19, 1997

[54] SPEECH COMPRESSOR USING TRELLIS ENCODING AND LINEAR PREDICTION

[75] Inventors: Victor D. Kolesnik; Victor Yu Krachkovsky; Boris D. Kudrjashov; Eugene P. Ovsjannikov; Boris K. Trojanovsky; Vladimir V. Egorov, all of St. Petersburg, Russian Federation

[73] Assignees: Alaris, Inc., Fremont; GT Technology, Inc., Saratoga, both of Calif.

[21] Appl. No.: 665,642

[22] Filed: Jun. 18, 1996

Related U.S. Application Data

[63] Continuation of Ser. No. 97,712, Jul. 26, 1993, abandoned.

[51] Int. Cl.[6] ..... G10L 3/02; G10L 9/00

[52] U.S. Cl. ..... 395/228; 395/251; 395/214

[58] Field of Search ..... 395/2.28, 2.51, 395/2.74, 2.77, 2, 2.71, 2.45, 2.32, 2.14

[56] References Cited

U.S. PATENT DOCUMENTS

| | | | |
|---|---|---|---|
| 4,472,832 | 9/1984 | Atal et al. | 381/40 |
| 4,736,428 | 4/1988 | Deprettere et al. | 381/38 |
| 4,790,016 | 12/1988 | Mazor et al. | 381/36 |
| 4,817,157 | 3/1989 | Gerson | 381/40 |
| 4,868,867 | 9/1989 | Davidson et al. | 381/36 |
| 4,896,361 | 1/1990 | Gerson | 381/40 |
| 4,912,764 | 3/1990 | Hartwell et al. | 381/38 |
| 4,914,701 | 4/1990 | Zibman | 381/36 |
| 4,924,508 | 5/1990 | Crepy et al. | 381/38 |
| 4,932,061 | 6/1990 | Kroon et al. | 381/30 |
| 4,944,013 | 7/1990 | Gouvianakis et al. | 381/38 |
| 4,969,192 | 11/1990 | Chen et al. | 381/31 |
| 4,980,916 | 12/1990 | Zinser | 381/36 |
| 5,012,518 | 4/1991 | Liu et al. | 381/42 |
| 5,060,269 | 10/1991 | Zinser | 381/38 |
| 5,073,940 | 12/1991 | Zinser et al. | 381/47 |
| 5,177,799 | 1/1993 | Naitoh | 381/34 |
| 5,187,745 | 2/1993 | Yip et al. | 381/36 |
| 5,195,137 | 3/1993 | Swaminathan | 381/32 |
| 5,199,076 | 3/1993 | Taniguchi et al. | 381/36 |
| 5,222,189 | 6/1993 | Fielder | 395/2 |
| 5,233,659 | 8/1993 | Ahlberg | 381/30 |
| 5,235,671 | 8/1993 | Mazor | 395/2 |
| 5,255,339 | 10/1993 | Fette et al. | 395/2 |
| 5,369,724 | 11/1994 | Lim | 395/2.15 |
| 5,388,181 | 2/1995 | Anderson et al. | 395/212 |
| 5,394,508 | 2/1995 | Lim | 395/2.38 |
| 5,414,796 | 5/1995 | Jacobs et al. | 395/2.31 |

OTHER PUBLICATIONS

Zinser, Richard L., Koch, Steven R., "Celp Coding at 4.0 KB/SEC and Below: Improvements to FS-1016," IEEE, (1992), pp. I313–I316.

Lupini, Peter, Cox, Neil B., Cuperman, Vladimir, "A Multi-Mode Variable Rate Celp Coder Based on Frame Classification," pp. 406–409.

Wang, Shihua, Gersho, Allen, "Improved Phonetically-Segmented Vector Excitation Coding at 3.4 KB/S," IEEE, (1992), pp. I349–I352.

(List continued on next page.)

*Primary Examiner*—Allen R. MacDonald
*Assistant Examiner*—Richemond Dorvil
*Attorney, Agent, or Firm*—Blakely, Sokoloff, Taylor & Zafman, L.L.P.

[57] ABSTRACT

A speech compressor utilizing Trellis Encoding and Linear Prediction (TELP). A TELP speech compressor provides improved signal generation and search technique for a code-excited linear prediction (CELP) speech encoder. TELP is a frame oriented coding that breaks the quantized speech signals into frames of prescribed length N and each frame into subframes of prescribed length L, which are processed as dependent units utilizing an analysis-by-synthesis approach. The approach is based on constructing the best mean square linear predicting filter and searching the best exciting sequence for the filter in order to produce synthesized speech. A trellis encoder is used instead of a stochastic code book. The Q-ary analysis of a given subframe and previous excitations is proposed for a fast vector search in an adaptive code book. It simplifies the implementation of digital speech compression.

17 Claims, 9 Drawing Sheets

OTHER PUBLICATIONS

Xiongwei, Zhang, Xianzhi, Chen, "A New Excitation Model for LPC Vocoder at 2.4 KB/S," IEEE, pp. I65–I68.
Liu, Y.J., "On Reducing the Bit Rate of a Celp–Based Speech Coder," IEEE, (1992) pp. I49–I52.
Hussain, Yunus, Farvardin, Nariman, "Finite–State Vector Quantization Over Noisy Channels and its Application to LSP Parameters," IEEE, (1992) pp. II133–II136.
Haagen, Jesper, Neilsen, Henrik, Hansen, Steffen Duus, "Improvements in 2.4 KBPS High–Quality Speech Coding," IEEE, (1992) pp. II145–II148.
Babkin, V.F., "A Universal Encoding Method With Nonexponential Work Expenditure for a Source of Independent Messages," Translated from Problemy Peredachi Informatsii, vol. 7, No. 4, pp. 13–21, Oct.–Dec. 1971, pp. 288–294.
Trellis–Searched Adaptive Prediction Coding Malone et al., IEEE/ Dec. 1988.
Enumeration and Trellis Searched Coding Schemes for Speech LSP Parameters Malone et al., IEEE/Jul. 1993.
Joseph P. Campbell, Jr., The New 4800 bps Coding Standard, Nov. 14, 1989, Military & Government Speech Tech '89, pp. 1–4.
Bishnu S. Atal, Predictive Coding of Speech at Low Bit Rates, Apr. 1982, IEEE Transactions on Communications, vol. Com–30, No. 4, pp. 600–614.
Grant Davidson, complexity Reduction Methods For Vector Excitation Coding, 1986, IEEE, pp. 3055–3058.
Thomas J. Lynch, Data Compression Techniques And Applications, 1985, pp. 32–33.

| LIST OF DIFFERENT TRELLIS EDGE SUBBLOCKS | |
|---|---|
| NO. OF EDGE | EDGE |
| 1 | 1 0 1 |
| 2 | 0 -1 0 |
| 3 | 2 0 0 |
| 4 | 0 1 0 |
| 5 | -2 0 0 |
| 6 | -1 0 -1 |

| TRANSITION STRUCTURE OF THE TRELLIS | | | |
|---|---|---|---|
| INITIAL STATE | FINAL STATE | NO. OF EDGE | INFO. SYMBOL |
| 1 | 1 | 1 | 0 |
| 1 | 2 | 2 | 1 |
| 2 | 1 | 3 | 0 |
| 2 | 3 | 5 | 1 |
| 3 | 2 | 4 | 0 |
| 3 | 3 | 6 | 1 |

SPEECH COMPRESSOR USING TRELLIS ENCODING AND LINEAR PREDICTION

This is a continuation of application Ser. No. 08/097,712, filed Jul. 26, 1993, now abandoned.

BACKGROUND OF THE INVENTION

1. Field of the Invention

The present invention generally relates to speech coding at low bit rates, and more particularly, is directed to an improved technique for storing and searching the excitation code book of linear predictive speech coders.

2. Description of the Related Art

A goal of effective digital speech coding is to provide an acceptable quality of synthesized speech at low bit rates. The coding must also be fast enough to allow for real time implementation. These goals are achieved by methods based on the standard Linear Prediction (LP) technique. The characteristic features of these methods are described below.

The sampled and quantized speech signal is separated on frames and a LP (Linear Predicting) filter is constructed for each frame by conventional techniques. For each frame, the best excitation is determined, which being applied to the input of the LP filter, produces a synthesized signal close to the original speech signal on the frame. The best excitation is typically found through a look-up in a code book. One of the most effective approaches of this type is the Code Excited Linear Prediction (CELP) method which was disclosed in "Predictive Coding of Speech at Low Bit Rates", Atal, B.S., *IEEE Transactions on Communications,* vol. COM-30, No. 4, (April 1982), 600–614.

The CELP speech encoding method provides high quality digital speech compression at low bit rates at the cost of extremely high complexity of the excitation search procedure. FIG. 1 illustrates how the best excitation for an LP filter such that the output of the filter closely approximates input speech is found in CELP.

In each frame the input speech signal is processed to estimate the linear predictive filter A(z) of a prescribed order. In order to find the excitation the frame is divided into several subframes (speech vectors) of length L. Each speech vector is perceptually predistorted by passing through the linear filter 100 with the transfer function $W(z)=A(z)/A(\gamma Z)$ for some $\gamma$, where $0.8<\gamma<1$. The predistortion is known to be useful in improving the synthesized speech quality. The perceptually predistorted input speech vector u is approximated by the response $b_j$ of the linear system comprising a decoder synthesis filter $1/A(\gamma z)$ (called a short-term predictor) 104, a linear filter 103 called a long term predictor, and a multiplier 105 by the gain $g_j$ which is excited by the code word $c_j$ taken from the initially stored code book 102. In the CELP analysis method the best excitation for each subframe is found by searching the code word $c_j$ and computing a gain factor $g_j$ which jointly minimize the squared norm $\|d_j\|^2$ of the error vector $d_j=u-b_jg_j$:

$$\|d_j\|^2=(d_j,d_j)=d^2_{j1}+\ldots+d^2_{jn},$$

obtained from the output of subtracter 101. For this purpose an exhaustive search in a code book is performed to find the maximal value of the match function $$M_j=(u,b_j)^2/(b_j,b_j). \qquad \text{(equation 1)}$$

The optimal gain value for code word $c_j$ is thereby computed as $$gj=(u,b_j)/(b_j,b_j). \qquad \text{(equation 2)}$$

In the search process each word from the code book is filtered by the decoder synthesis filter and the energy $(b_j,b_j)$ and correlation $(u, b_j)$ values from equations (1) and (2) should be computed. Moreover, a large code book is used in order to achieve high speech quality. Therefore, the code book search in CELP is an extremely time consuming process.

For the CELP method there exist various techniques of reducing computation complexity. Such techniques were reported in the following references:

Davidson, G., and Gersho, A., "Complexity Reduction Methods for Vector Excitation Coding", *IEEE-IECEI-ASJ International Conference on Acoustics, Speech and Signal Processing,* vol. 4, (April 7–11, 1986), pp. 3055–3058;

P. Kroon, B. Atal, "On Improving the Performance of Pitch Predictors in Speech Coding Systems", *Abstracts of the IEEE Workshop on Speech Coding for Telecommunications,* 1989, P.49–50;

J. P. Campbell, T. E. Tremain, V. C. Welch, "The DOD 4.8 kbps Standard (Proposed Federal Standard 1016)", Advances in Speech Coding, Ch.4.1, Kluwer Academic Publishers, 1990. B. Atal, V. Cuperman, A. Gersho—Editors.

Federal Standard 1016, Telecommunications: Analog to Digital Conversion of radio voice by 4,800 bit/second Code Excited Linear Prediction (CELP). February, 1991.

Despite the foregoing prior techniques, the problem of reducing the time for the code book search and the effective size of the code book remain the most important factors for a real time implementation. In U.S. Pat. No. 4,817,157 Gerson a "vector sum" code book is described. The "vector sum" code book generation approach is a faster implementation of the code book search, but still requires approximately 2,600,000 multiply-accumulate (MAC) operations per second. This value does make possible a practical real time implementation using a single Digital Signal Processor (DSP).

A second concern is the storage requirements for the code book. The size of the code book is the product of the number of code words and the number of samples per code word.

The typical code book size is $V_s=1024$ code words of length L=40 samples. In U.S. Pat. No. 4,817,157 a code book storing system based on keeping $\log_2 V_s$ basis vectors of length L is proposed. Such a "vector sum" system requires $L*\log_2 V_s=40*10=400$ ternary (+1, −1, 0) memory cells and is useful for search simplification.

The reduction of storage requirements and complexity for code excited linear prediction systems remains a key problem in practical implementation of digital speech coding. The principal object of the present invention is to provide a high quality speech coding at data rates of approximately 4800–9600 bit per second, that satisfies time and memory requirements of a realtime hardware implementation.

SUMMARY

An improved signal generation and search technique are described for a code-excited linear prediction (CELP) speech encoder using a trellis structure stochastic code book. The technique is termed Trellis Encoding with Linear Prediction (TELP). TELP is a frame oriented coding that breaks the quantized speech signals into flames of prescribed length N and each flame into subframes of prescribed length L, which are processed as dependent units. TELP uses a similar analysis-by-synthesis approach to that of CELP. It is based on constructing the best mean square linear predicting filter and searching the best exciting sequence for the filter in order to produce synthesized speech.

An important principle of the present invention is the replacement of a vector code book in a code excited linear predictive coder (CELP) of speech by a trellis code book which requires a much smaller memory size and reduced computational complexity for encoding than in CELP. The excitation code vectors of a subframe are generated according to the prescribed trellis structure specified by a selected trellis code. Compared with CELP, this fundamental difference simplifies the implementation of a digital speech compression system.

The speech encoder includes a linear prediction analyzer module for the converting of input speech to the sequence of linear predictive coding (LPC) parameters, a ringing removal and perceptual weighting module, a long term prediction analyzer for removing periodic components, a trellis decoder module for computing a trellis index of an excitation code vector and evaluating the optimal trellis gain for this trellis index. The trellis excitation gain and index, the long term prediction gain and index and also the LPC parameters are quantized and multiplexed at the analyzer output.

The present invention includes a trellis decoder for converting a decoder input signal into the trellis index and trellis gain parameters. In accordance with the technique, trellis decoding is performed by computing accumulated correlations and energies for all competing edges incoming to a given trellis state and making a decision on the surviving edge for this state by comparing the values of a match function computed for the competing edges. The decoder further embodies a fast technique for computation of filter responses on trellis edges in the decoding process.

The invention also comprises an implementation of a fast search in a long-term prediction analyzer to compute the adaptive code book gain and index. It provides a fast vector search in the adaptive code book on the base of the Q-ary analysis of a given subframe and previous excitations.

In the preferred embodiment of the speech compressor the LPC parameters are interpolated for subframes of a given frame to improve the synthesized speech quality. The speech coding system also includes quantizers of gains and LPC parameters.

The present invention further encompasses a corresponding speech synthesizer having a quantization and an interpolation module to restore the LPC parameters on successive subframes, a long term prediction module and trellis encoding module to restore the excitation from the received gains and indexes.

DETAILED DESCRIPTION OF THE PREFERRED EMBODIMENT

A method and apparatus for Code Excited Linear Prediction (CELP) type speech encoding, utilizing Trellis Encoding with Linear Prediction (TELP), is described. In the following description, numerous specific details are set forth such as a description of CELP, in order to provide a thorough understanding of the present invention. It will be apparent, however, to one skilled in the art that the present invention may be practiced without these specific details. In other instances, well-known functionality such as analog to digital conversions, have not been shown in detail in order not to unnecessarily obscure the present invention.

The present invention has application wherever speech compression or synthesized speech is used. Speech compression may be used in voice communications. Speech synthesis may be used in toys, games, telephone answering devices and computer systems. A current constraint on the use of synthesized speech is the speed of decoding and the amount of memory needed to store such synthesized speech. In the currently preferred embodiment, a processor is used to perform the speech coding and encoding. The speech data will reside on a memory device external to the processor. However, it would be apparent to one skilled in the art to combine the processor and memory device onto a single integrated processor.

Further, in some embodiments of the present invention, the synthesized speech will be created on one system and reproduced on another. For example, a game or toy with predetermined audible responses would only decode synthesized speech. The foregoing embodiments are exemplary and not meant to be limiting. It would be apparent to one skilled in the art to use the present invention for any application requiring speech compression or synthesized speech.

Figure 1:
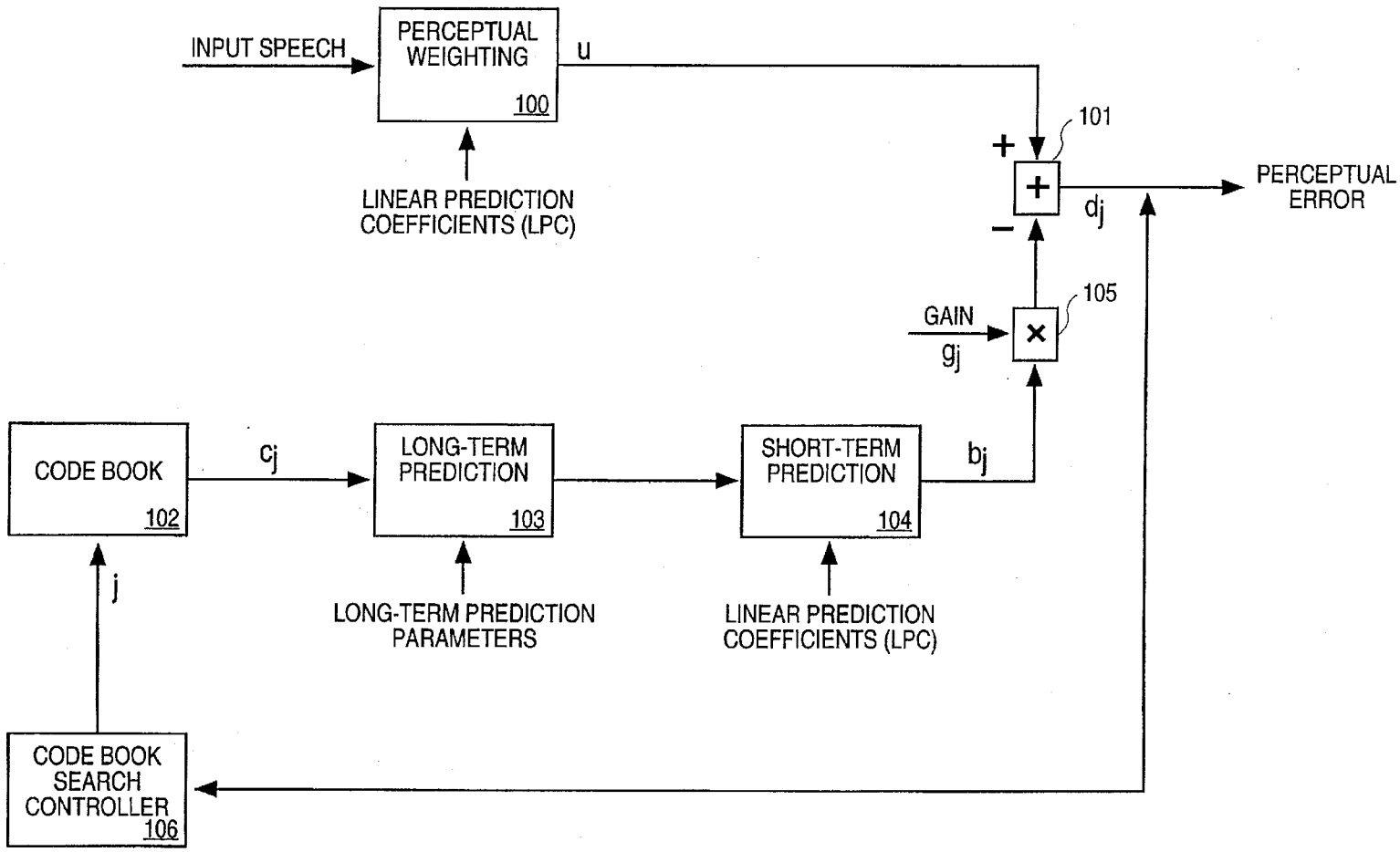
FIG. 1 (PRIOR ART)
FIG. 1 is a block diagram illustrating the computation of the perceptual error in a Code-Excited Linear Prediction (CELP) analyzer as performed in the prior art.
Figures 2A, 2C:
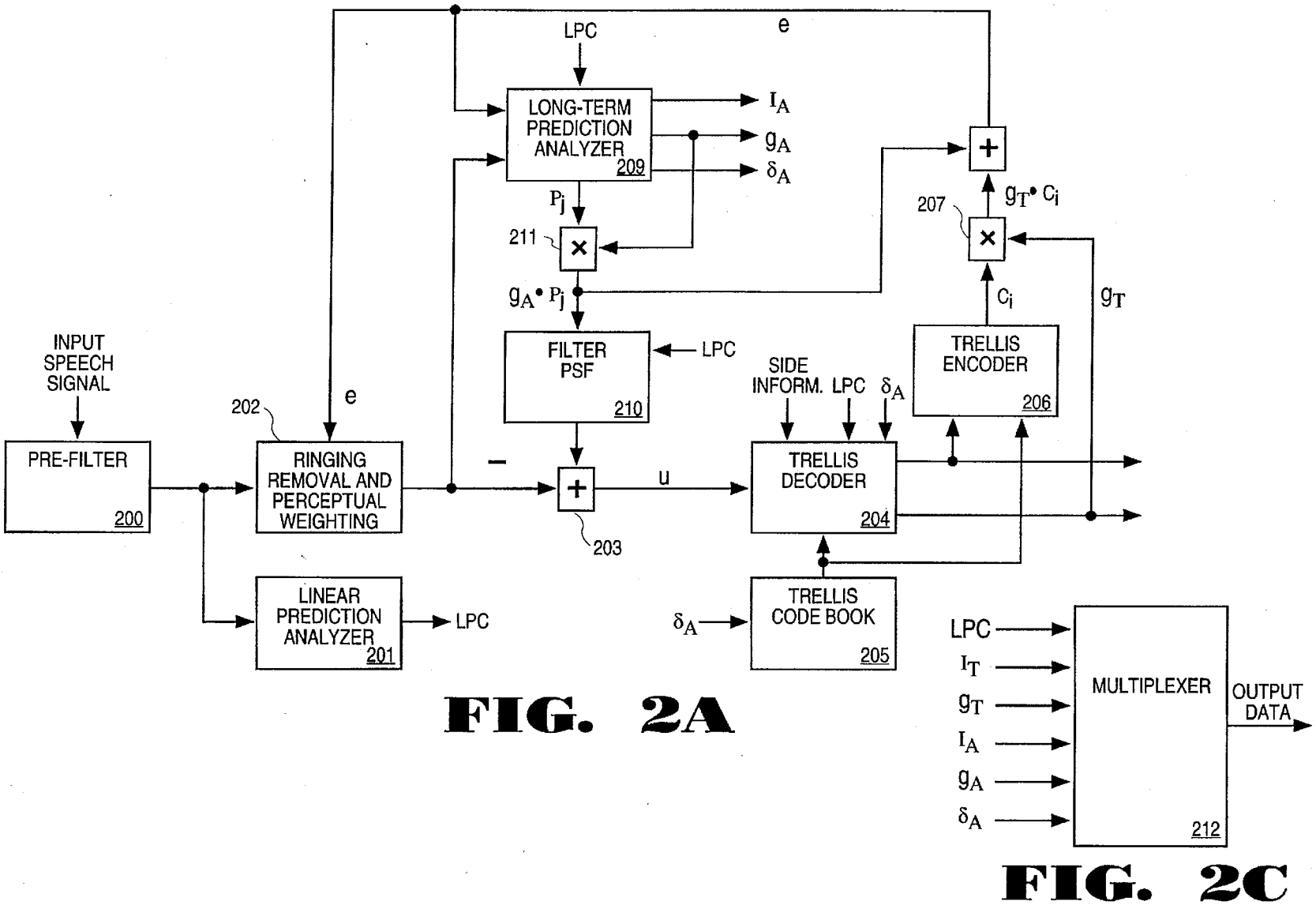
FIG. 2A is a block diagram of a speech analyzer utilizing Trellis Encoding and Linear Prediction (TELP) of the currently preferred embodiment of the present invention.
FIG. 2C is a block diagram of a multiplexer used to multiplex the parameters of given frame.

The block diagram in FIG. 2A shows the implementation of the Trellis Encoding and Linear Prediction (TELP) speech analyzer. In FIG. 2A the details related to the analog to digital conversion are omitted. The digital speech signal which was sampled at a rate between 7 and 8 KHz is previously processed by a fixed digital pre-filter 200. The purpose of such prefiltering coupled with the corresponding postfiltering is to diminish the specific synthetic speech noise. Even using the simplest type of the first order prefilter $1-\beta.z^{-1}$ and post-filter $1/(1-\beta.z^{-1})$ with $\beta$ lying between 0.7 and 0.9, some improvements in synthesized speech quality has been observed.

Pre-filtered speech is analyzed by the linear prediction analyzer 201 in order to produce a set of linear prediction coefficients (LPC) $a_1, \ldots, a_m$ which define for a given frame the LP analysis filter (AF) of prescribed order m (the inverse to this filter is called a short-term prediction filter)

$$A(z)=1-a_1z^{-1}-a_2z^{-2}-\ldots-a_mz^{-m} \quad \text{(equation 3)}$$

Generally, a filter order m of not less then 10 is acceptable. The linear prediction analysis is performed for each speech frame of about 30 msec duration and is accomplished by the quantization of LP parameters. These parameters, found once in a frame, are transferred to the output of the analyzer among other data. The LP parameters for subframes are produced by well known interpolation technique from the quantized LP parameters for frames.

The frame consisting of N samples is partitioned to subframes of L samples each. Therefore the number of subframes in a frame is equal to N/L. The next speech analysis has been performed by subframes. In a typical implementation the number of subframes is equal to 4, 5 or 6. The filter coefficients, reflection coefficients and logarithmic cross-section area ratios could be chosen as a suitable basis for the filter interpolation for subframes.

The unit 202 consists of various filters and performs two functions. First, it removes ringing caused by the past subframe synthesized speech signals. This function results in the ability to process speech vectors for different subframes independently of each other. Second, module 202 performs the perceptual weighting of speech spectral components in order to decrease the format peaks in a speech signal. As in CELP, perceptual weighting is realized by passing the prefiltered speech signals through the weighting filter (WF)

$$W(z)=A(z)/A(\gamma z), \quad \text{(equation 4)}$$

with a parameter $\gamma$ taken from a range between 0.8 and 1.0. The main purpose of the perceptual weighting is to reduce the level of the synthesized speech noise components lying in the most audible spectral regions between speech formats. Another positive effect of this is in shortening the response of the Decoder Synthesis Filter (DSF), which is described in greater detail below. The trellis decoder input vector $u=(u_1, u_2, \ldots, u_L)$ is produced in the output of the adder 203 which removed the scaled periodic (pitch) component from the output of the unit 202. This pitch component is found by the analysis of the adaptive code book content in the long-term prediction analyzer 209 passed through the Perceptual Synthesis Filter (PSF) 210. The trellis decoder 204 uses the trellis code book memory 205 to construct the words of a trellis code and to search for an approximation of the input vector u by a zero-state response of the Decoder Synthesis Filter (DSF) excited by words of the trellis code. The transfer function of this filter could be chosen as $$B(z)=1/A(\gamma z) \quad \text{(equation 5)}$$

The best code word $c_i$ is found by performing the decoding procedure in the trellis decoder 204. The optional parameter $\delta_A$ computed by the long-term prediction analyzer and some side information taken from the input vector analysis may be used to improve the decoder performance. The trellis index $I_T=i$ of the found code word $c_i$ as well as an optimal gain value $g_T=g(u,c_i)$ are transferred into the decoder output.

A feedback loop, formed by the units 203, 204, 205, 206, 207, 208, 209, 210 and 211, removes the pitch component from perceptually predistorted speech and at the same time produces the subframe innovation for an adaptive code book in the long-term prediction analyzer 209. This innovation is produced in several steps. The trellis encoder 206 transforms the trellis index $I_T$ into the code word $c_i$, multiplier 207 multiplies $c_i$ by the trellis gain factor $g_T$ and the adder 208 sums the scaled code word $g_T \cdot c_i$ and excitation vector pj, multiplied in the multiplier 211 by the adaptive code book gain factor $g_a$, to produce the updating excitation $e=g_T \cdot c_i + g_A \cdot pj$ for a given subframe. The scaled excitation vector $g_A$*pj is also applied to the PSF 210 in order to produce the scaled pitch vector for the current subframe. The excitation vector pj appears in analyzer 209 as a result of the joint analysis of the past excitation vectors stored in the memory (adaptive code book) and a given vector of perceptually predistorted speech. For the found vector $p_j$, the adaptive code book index $I_A=j$ and the gain $g_A$ are calculated. The excitation vector e is additionally supplied to the unit 202 for ringing removal.

As it has been experimentally established, the long term prediction analysis could be ineffective in segments with the fast speech character changing. In these cases, an additional vocalization analysis performed by the long-term prediction analyzer 209, together with the appropriate changing of the trellis may be of use. For this purpose the optional parameter $\delta_A$ is introduced for indicating the effectiveness of the long term prediction for a given subframe that may be used to control the trellis code parameters.

The above mentioned parameters LPC, $I_T$, $g_T$, $I_A$, $g_A$, $\delta_A$ for a given frame are multiplexed by the multiplexer 212 and transmitted from the TELP analyzer into the channel or memory.

Figure 2B:
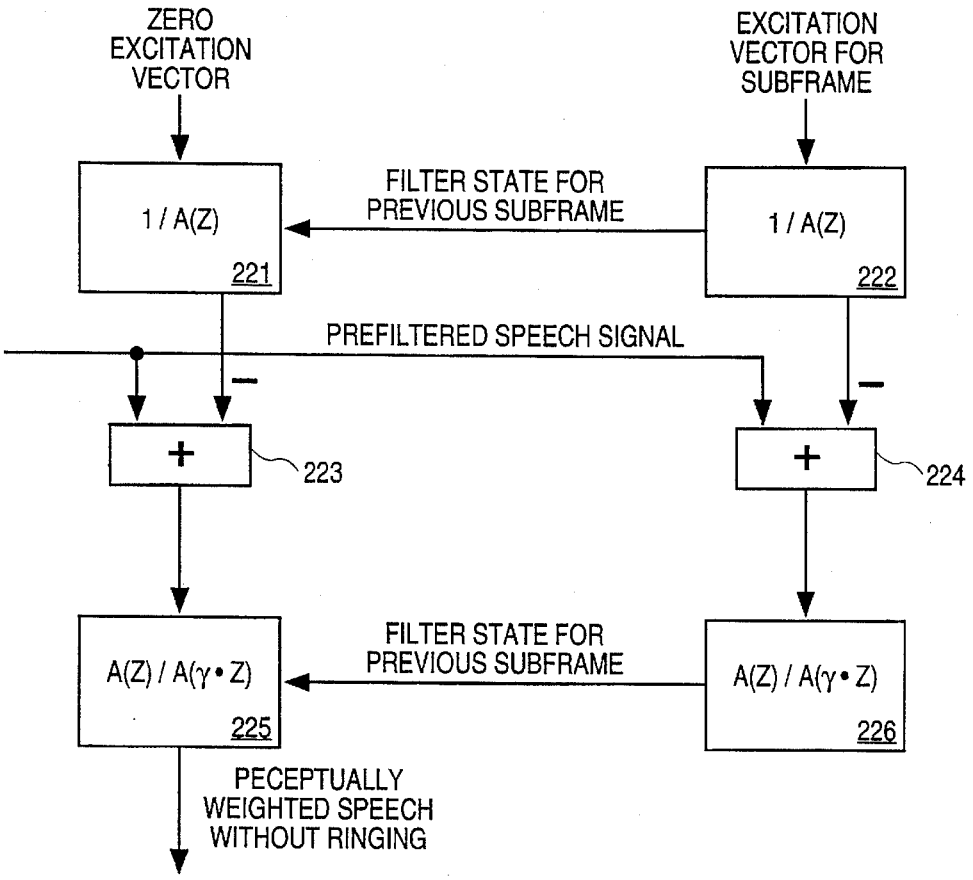
FIG. 2B is a block diagram of the perceptual weighting and ringing removal unit from the TELP speech analyzer of FIG. 2A of the currently preferred embodiment of the present invention.

The perceptual weighting and ringing removal unit 202 of FIG. 2A is further described with reference to FIG. 2B. There are two synthesis filters 1/A(z) (SF) 221, 222 and two weighting filters (WF) 225, 226. The excitation vector e is applied to the filter 222 starting from the state achieved to the end of the previous subframe in order to produce the synthesized speech vector for the current subframe. The zero excitation vector is applied to the filter 221 starting from the state achieved by the filter 222 to the end of the previous subframe in order to produce the ringing vector for the current subframe. The output of the adder 224 is the approximation error vector. The output of the adder 223 is the speech vector without ringing. The approximation error vector is applied to the filter 226 starting from the state achieved to the end of the previous subframe. The filter 225 uses the same state as achieved by the filter 226 to the end of the previous subframe to produce the perceptually weighted speech vector without ringing for the current subframe.

Trellis Encoding

Figures 3A, 3B, 3C:
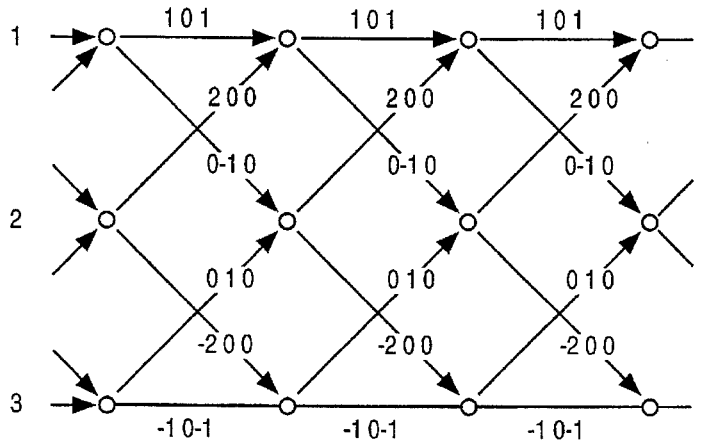
FIG. 3A is a table illustrating the trellis edge subblocks.
FIG. 3B is a table illustrating the transition structure of the trellis.
FIG. 3C is an example of a trellis with the parameters M=3, n=3, information rate ⅓ (bit for a sample) as may be utilized in the currently preferred embodiment of the present invention.

Trellis encoding of speech is now discussed in more detail. The trellis is usually defined as a directed graph comprising of a set of states (called trellis states) connected by edges. It has a periodical structure that repeats the same sets of states and transitions from level to level. A possible trellis structure is presented at FIGS. 3A, 3B, and 3C. The edges are labeled by sequences of code symbols of fixed length n which are called subblocks. The main trellis parameters are: the subblock length n, the number of states M, the number of different edges in a trellis and the number of edges k outgoing from a state. The information code rate is defined thereby as $R=(\log_2 k)/\eta$ bits per sample.

Any sequence of subblocks on the consecutive edges (in a path) of a trellis is called a code word and a set of all code words is called a trellis code. Any word of the trellis code is uniquely determined by the initial state of the trellis and by the sequence of edges which corresponds to the path in the trellis. For each subframe the trellis code word consists of the prescribed number $l=L/n$ subblocks. We shall denote the initial state index by $I_o$, $I_o=0, \ldots M-1$, and the transition at a level t, $t=1, \ldots, l$, by $I_t$, $I_t=0, \ldots, k-1$. Therefore, each code word could be identified by the sequence of indexes $(I_0, I_1, \ldots, I_l)$ or, equivalently, by some integer index $I_T$ having been calculated from the sequence $(I_0, I_1, \ldots, I_l)$.

Now, the implementation of the trellis decoder is considered in more detail. The decoder input vector u is partitioned into I subblocks of length n $$u=(u_1,u_2, \ldots, u_l),\ u_t=(u_{t1},u_{t2}, \ldots, u_{tn}), t=1, \ldots l.$$

The subblocks $u_t$ are processed at the trellis level t. Similar to the original CELP method, the trellis decoder searches for a code word $c_i$ and a gain $g_i$ that jointly minimize the squared Euclidean distance $$D^2=\|u-g_i b_i\|^2 \quad \text{(equation 6)}$$

between the decoder input vector u and the scaled by a factor $g_i$ zero-state response $b_i=(b_{i1}, \ldots, b_{iL})$ of the decoder synthesis filter (DSF) B(z) excited by the trellis code word $c_i$. Given vectors u and $b_i$, the value $g_i$ of the scale factor minimizing the distance D, may be expressed as follows $$g_i=(u,b_i)/(b_i,b_i). \quad \text{(equation 7)}$$

Therefore the search problem can be reduced to the following: find the index i, which maximizes the match function $$M_i=(u,b_i)^2/(b_i,b_i), \quad \text{(equation 8)}$$

over all words $c_i$ of the trellis code. Here we denote by (a,b) the inner product of two vectors a and b.

To avoid the exhaustive search over a whole trellis code book of a large size, the trellis decoding method is used wherein the decoder input vector $u=(u_1, \ldots, u_t, \ldots, u_l)$ is processed by subblocks. The values of accumulated correlations $AC_{ts}$ and energies $AE_{ts}$, that will be discussed later, are computed for each trellis state $1<s<M$, and each level t, $1<t<L$ The trellis decoding method for speech compression is similar to the general Viterbi decoding procedure, which is well known for error correcting trellis codes (see, e.g., G. C. Clark and J. B. Cain, "Error-Correction Coding for Digital Communications", Plenum Press, NY-London, 1981). Starting from the zero level, the trellis decoder finds the best paths to the states at the level t+1, knowing the current subblock $u_{t+1}$ and survived paths incoming to the states at the level t with their accumulated correlations $AC_{ts}$ and energies $AE_{ts}$. For this purpose it resets new correlations and energies for each state s at the level t+1 by choosing the edge between all edges incoming to s which maximizes the match function.

The following shows how the trellis decoder does this. Let Edges (t, s) be the set of all edges incoming to the state s at the trellis level t+1. The following procedure is used for determining the paths surviving to the level t+1. At first, the DSF generates the responses $b_j$ of length n, $0<j<k-1$, k=# Edges (t, s), for all subblocks corresponding to the edges from the set Edges (t,s). After that the energy $$E_j=b^2_{j1}+b^2_{j1}+\ldots+b^2_{jn} \quad \text{(equation 9)}$$

and the correlation $$C_j=b_{j1}\cdot u_{t1}+b_{j2}\cdot u_{t2}+\ldots+b_{jn}\cdot u_{tn} \quad \text{(equation 10)}$$

are evaluated for each j. Then the match function is computed as follows $$M_{t+1,j}=(AC_{ts'}+C_j)^2/(AE_{ts'}+E_{tj}) \quad \text{(equation 11)}$$

where s' denotes the state from which the edge j is outgoing. That edge j from Edges (k,i) survives at the state s for which the maximum value of equation 11 is achieved. An index of the surveyed edge or the transition leading to state s is then stored in paths memory. The decoder assigns new values to accumulated correlations and energies $$AC_{(t+1),s}=AC_{ts'}+C_j,\ AE_{(t+1),s}=AE_{ts'}+E_j, \quad \text{(equation 12)}$$

where (s,s') is a pair of states connected by the survived edge j. Then it repeats this process till the end of subframe and completes calculations for the subframe by choosing the path that goes to such a state s at the final level l for which the match function $$M_{ls}=AC^2_{ls}/AE_{ls}. \quad \text{(equation 13)}$$

has a maximal value. The initial state for this survived path is uniquely determined by this path and the final state whereas the trellis index $I_T$ is determined by the initial state and by survived edge indexes for the survived path stored in the path memory. In accordance the trellis gain is found as $$g_T=AC_{ls}/AE_{ls} \quad \text{(equation 14)}$$

for the final state s. It goes to the output of the decoder together with the trellis index.

Figure 4A:
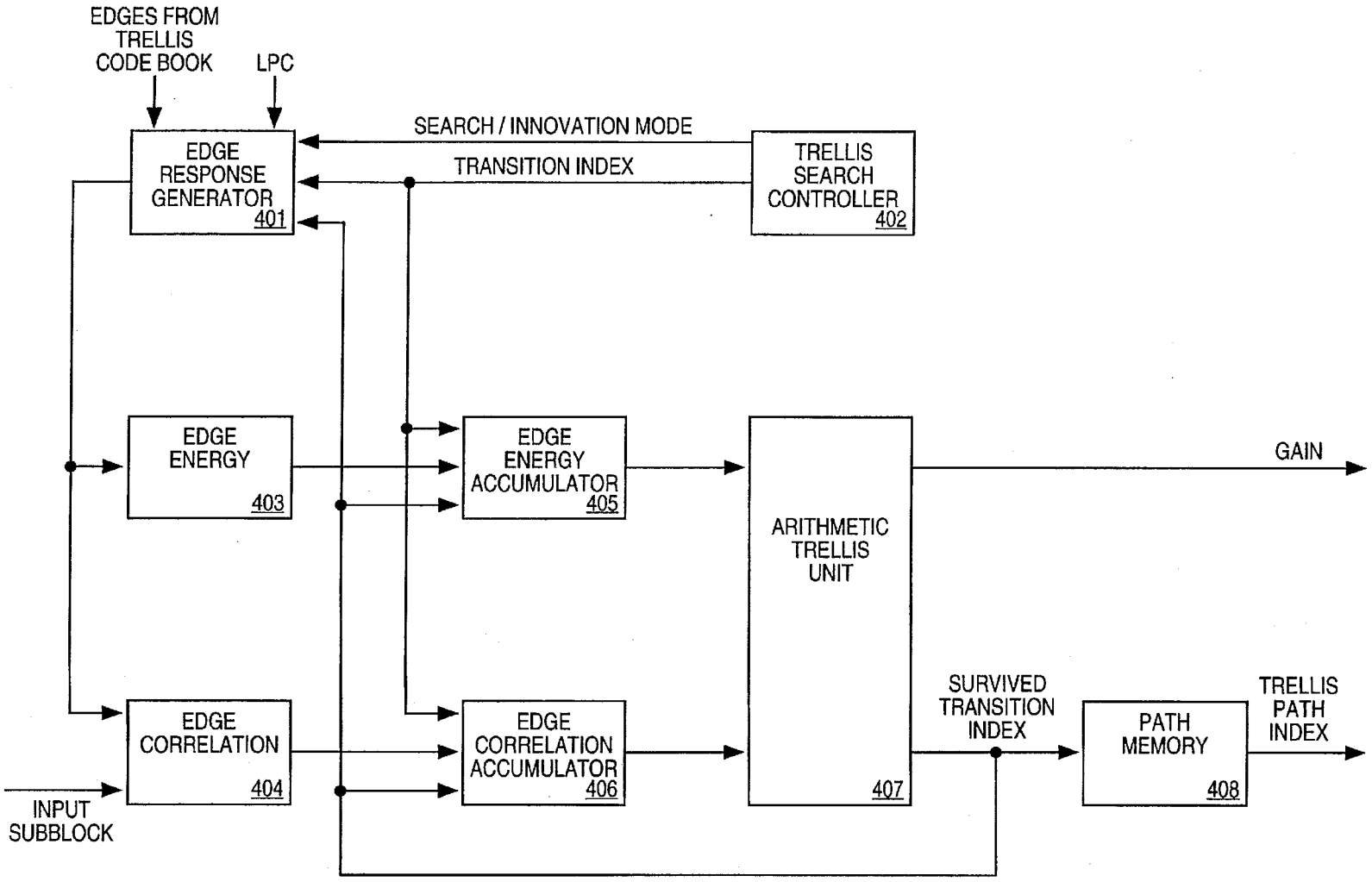
FIG. 4A is a block diagram of the trellis decoder for speech compression unit of FIG. 2A of the currently preferred embodiment of the present invention.

FIG. 4A illustrates the implementation of the trellis decoder for speech compression. The edge response generator 401, controlled by a transition index and the search/innovation control signal from the trellis search controller 402, generates the DSF responses $b_j$, for the subblocks corresponding to the set Edges (t,s) for each state s on a given trellis level t+1. For each state s the transition index is combined from two indexes j and s', where s' is the initial state for the edge j. The units 403 and 404 compute the energy $E_j$ and correlation $C_j$ for the subblocks taken from the unit 401. The edge energy accumulator 405 and the edge correlation accumulator 406 perform the computation of the accumulated energy $AC_{ts'}+C_j$ and the accumulated correlation $AE_{ts'}+E_j$ for edges from the decoded state s' at the level t. The trellis arithmetic unit 407 uses the accumulated energy and correlation values to determine the survived transition. This transition is transferred to the unit 401 and also resets the values $AC_{ts}$, $AE_{ts}$ in the accumulators 405, 406 (see equation 12). The survived transition indexes are stored in the path memory unit 408. When the decoding of the subframe is completed the unit 408 produces the trellis path index $I_T$ as its output.

Figure 4B:
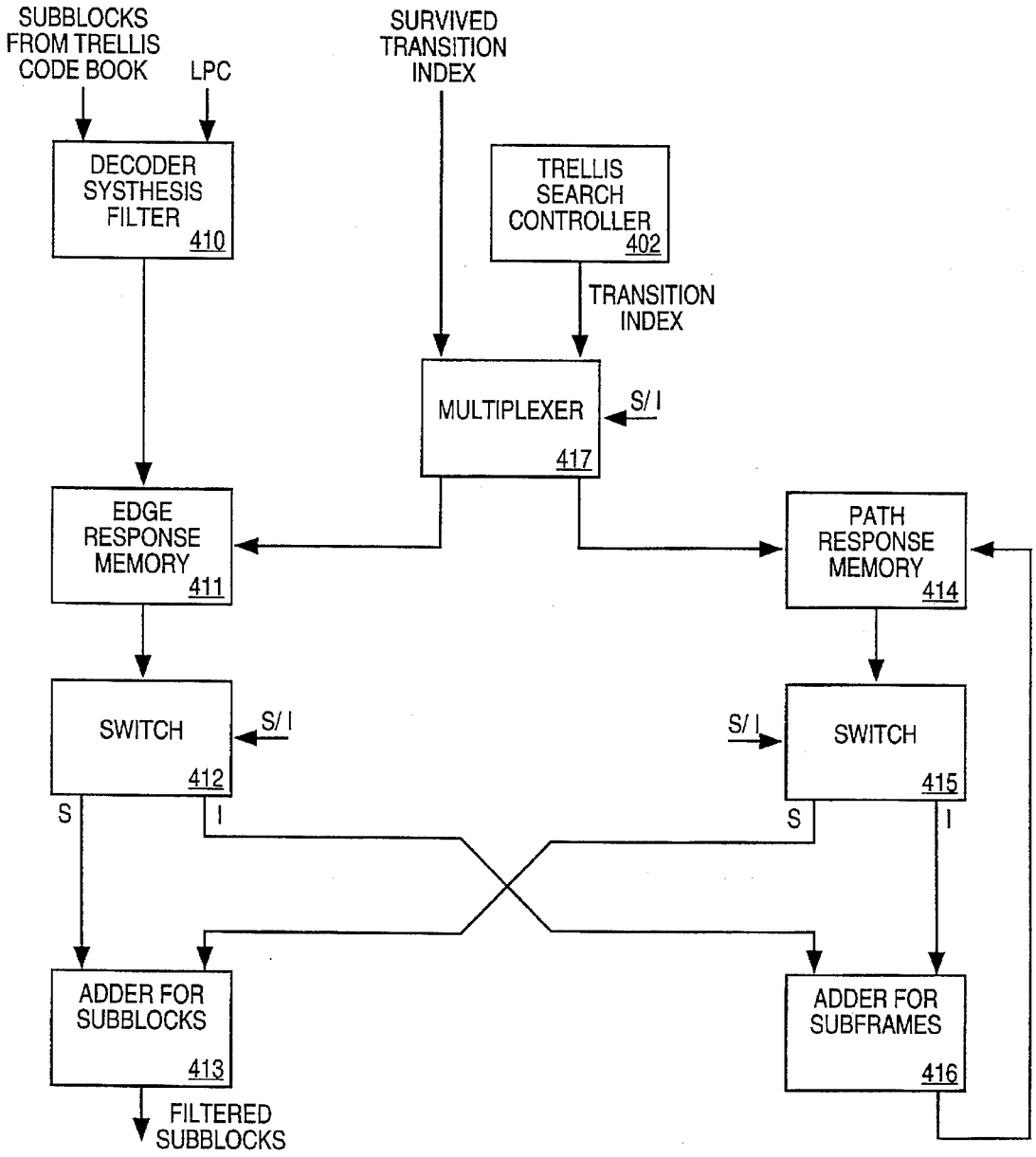
FIG. 4B is a block diagram of an edge response generator illustrated in FIG. 4A as may be utilized in the currently preferred embodiment of the present invention.

In FIG. 4B the implementation of the edge response generator 401 is shown in greater detail. The decoder synthesis filter 410 prepares the zero-state responses for all different subblocks from the trellis code book before the speech subframe processing begins. Responses of length L generated in such a way are stored in the edge response memory 411. An initial content of the path response memory 414 is set up to all zeros. For each level t the generator 401 performs computation by successive switching of two modes. In the search mode it generates the synthesized subblocks which could be used for approximating of the current subblock $u_t$ on the transitions of the trellis. In the innovation mode the path response memory 414 is innovated by the synthesized vectors for survived paths in each trellis state. Two modes are switched by a search/innovation (S/I) mode control signal incoming to switches 412, 415 and multiplexer 417 from the trellis search controller 402.

The decoder starts processing at the level t in the search mode. For each state s at the level t, 1<s<M, the trellis search controller 402 generates the edge j from the set Edges (t−1,s) and the outgoing trellis state s', dependent on the pair (j,s). Each edge index j is used as an address to the memory 411, while the state s' is used as an address in the memory 414. In the adder 413 the content of the addressed memory cell from the unit 411 is added with the content of the addressed memory cell from the unit 414 to produce the synthesized subblock for the given edge.

After the search for all states at the level t is completed the arithmetic trellis unit 407 supplies the survived transition indexes to the unit 401 which is reset to the innovation mode. These indexes are used to address the memory 411 and 414 in the same way as in the search mode. The contents of the addressed memory cell from 411 is added with the contents of the addressed memory cell from 414 in the adder 416 to produce the survived synthesized vector of length L for the given state s at the level t. All these vectors are stored in the path response memory 414.

Figure 5A:
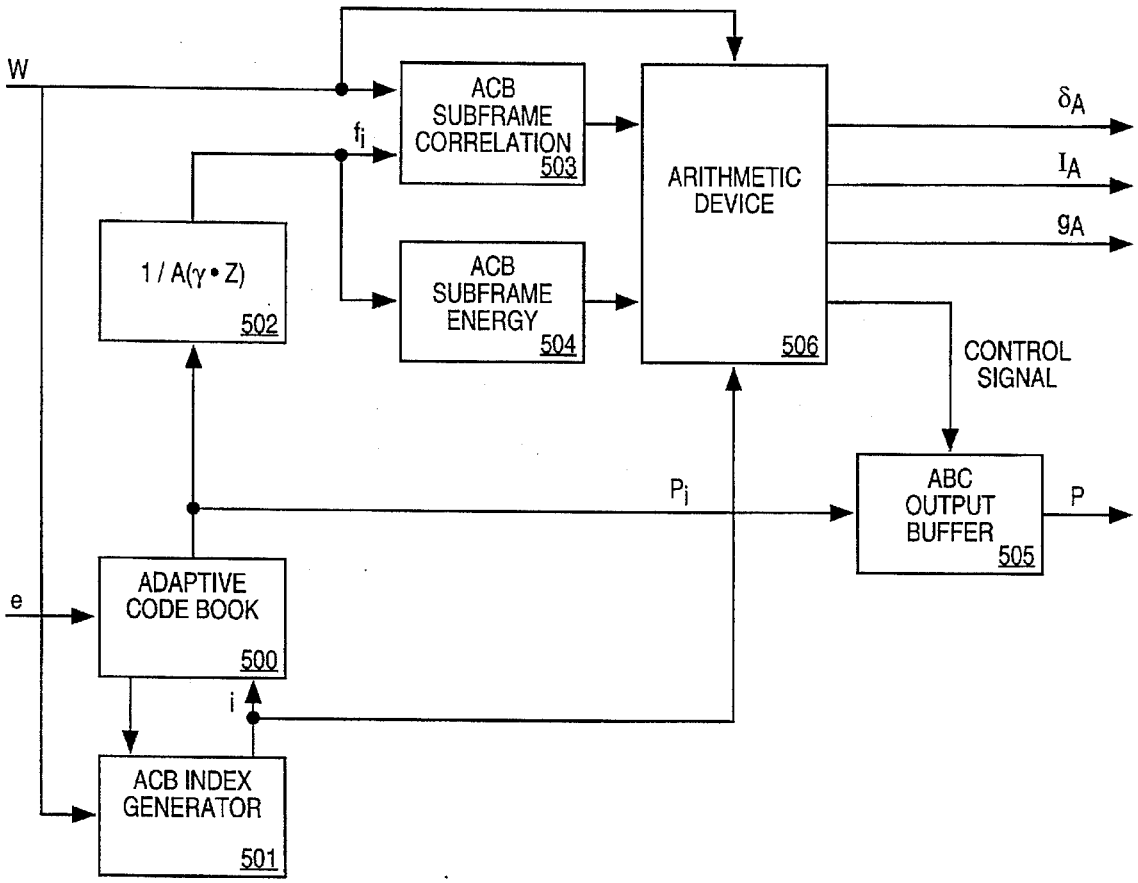
FIG. 5A is a block diagram of the long-term prediction analyzer of FIG. 2A as may be utilized in the currently preferred embodiment of the present invention.

Referring now the FIG. 5A, the organization of long-term prediction analyzer 209 is presented in greater detail. The samples of updating excitation vectors e from past subframes are stored in the Adaptive Code Book (ACB) 500. The index generator 501 prepares a list of indexes of the corresponding ACB excitation vectors used in a search. For a given subframe, the search for the best ACB excitation vector could be optionally performed in two modes of the complete or fast search. In the complete search mode the unit 501 generates a list of indexes of the maximal size $M_A$, where $M_A$ denotes the overall number of vectors which could be generated by the ACB, for example, $M_A$=128. In the fast search mode the unit 501 generates the list of indexes of much smaller size than $M_A$ (for example, 6 indexes) found by some preliminary analysis of the perceptually predistorted speech vector w and past excitation vectors stored in the ACB. The ACB excitation vector Pi is temporarily stored in the ACB output buffer and then passed through a zero state Perceptual Synthesis Filter (PSF) 502 to produce the filtered vector $f_i$. For this vector the subframe ACB correlation $(w,f_i)$ is computed in the block 503 as well as the subframe ACB energy $(f_i, f_i)$ is computed in the block 504. The arithmetic device 506 uses these correlation and energy values to find the best ACB index $I_A$=i, that maximizes the ACB match function $$M_i=(w,f_i)^2/(f_i,f_i) \qquad \text{(equation 15)}$$

The optimal ACB gain value $g_A$ is calculated for the best index i by the formula $$g_A=(w,f_i)/(f_i,f_i) \qquad \text{(equation 16)}$$

The ACB arithmetic device 506 produces the control signal which is used for saving the best ACB excitation vector in the buffer 505 found throughout the search. At the end of the search the best ACB excitation vector p goes to the output of the buffer 505.

In the present invention the ACB arithmetic device 506 also computes the optional parameter $\delta_A$ which indicates the effectiveness of the long term prediction for the given subframe. If the long term prediction is found effective then the device 506 sets $\delta_A$=1 and the output parameters $_g$A, IA and excitation vector p are processed as previously described. If the long term prediction is detected as ineffective then it sets $\delta_A$=0. In this case the excitation vector p found by the analyzer is replaced to a zero vector and the trellis code is replaced to another one having a higher information rate. The bits previously used for encoding of parameters $_g$A, IA in this subframe and some additional bits are now used for a trellis decoding with a higher information rate and better characteristics. For example, the parameter $\delta_A$ may be used to select one of two trellises with different code rates, stored in the trellis code book 205. The parameter $\delta_A$ evaluation could be the following. Given the ACB index $I_A$=i, the arithmetic device 506 computes the normalized match function $$\mu_i=(w,f_i)^2/((f_i,f_i)\cdot(w,w)). \qquad \text{(equation 17)}$$

If the absolute value of $\mu_i$ does not exceed some level lying between 0.2 and 0.3 then $\delta_A$=0, otherwise $\delta_A$=1.

Figure 5B:
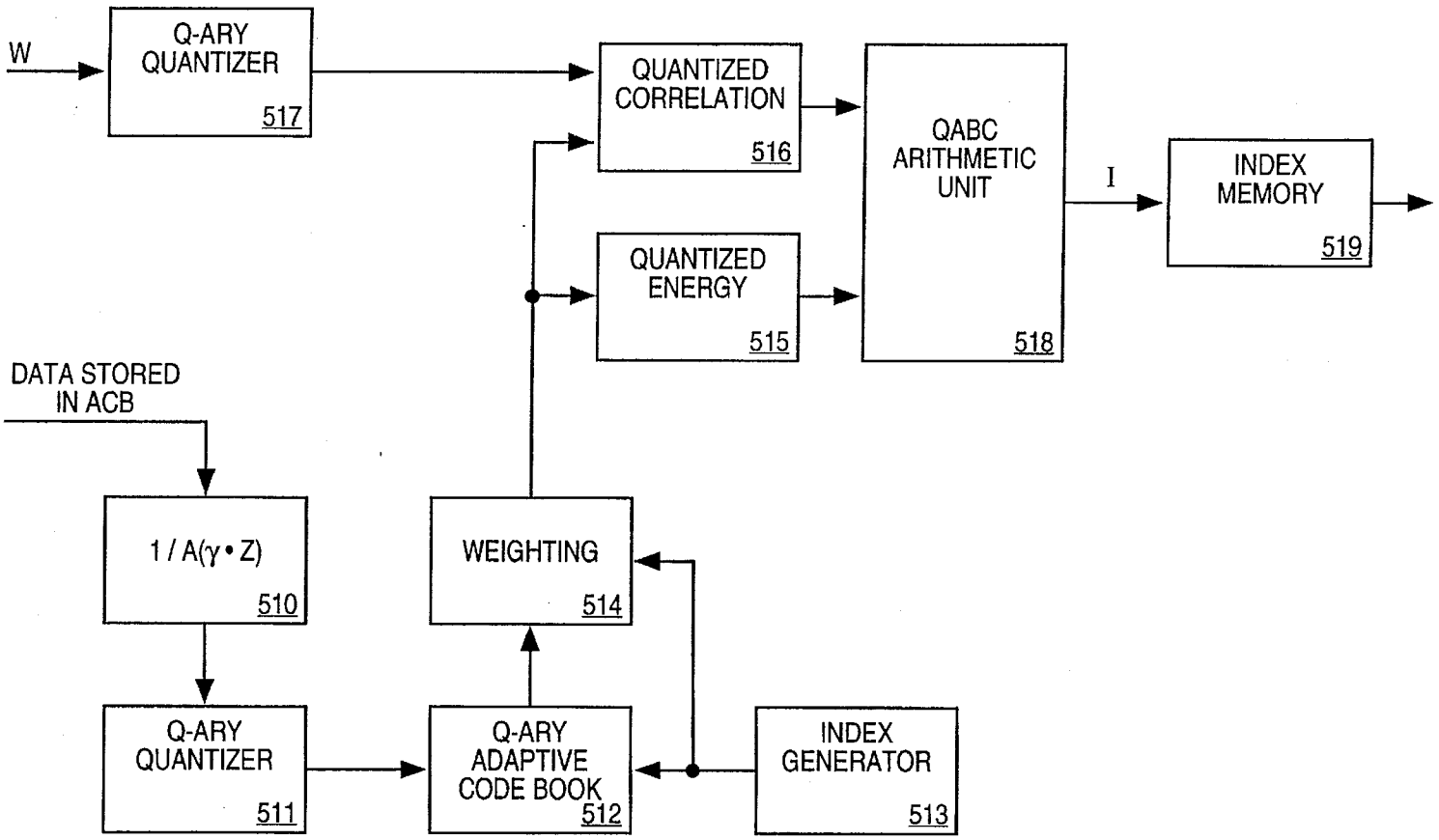
FIG. 5B is a block diagram of the Adaptive Code Book (ACB) index generator of FIG. 5A, which performs a fast search for a small size list of indexes as may be utilized in the currently preferred embodiment of the present invention.

Referring now to FIG. 5B, the implementation of the ACB index generator 501 for the fast search mode is illustrated in greater detail. The sequence of samples stored in the ACB 500 is filtered by the zero-state Perceptual Synthesis Filter (PSF) 510 and quantized by a Q-ary quantizer 511 to produce the filtered and quantized ACB excitation which is stored in the Q-ary adaptive code book (QACB) 512. The index generator 513 supplies QACB with $M_A$ indexes for generating the whole set of QACB vectors. Each QACB vector is weighted by some window in the weighting unit 514 to produce the weighted QACB vector $\tilde{f}_i$ transferred to the energy $(\tilde{f}_i, \tilde{f}_i)$ evaluation in the unit 515 and the correlation $(\tilde{f}_i,\tilde{w})$ evaluation in the unit 516, where $\tilde{w}$ is the quantized perceptually predistorted speech vector produced by the Q-ary quantizer 517. The QACB arithmetic unit 518 uses the values of correlation and energy for determining and storing in the index memory 519 the list of K ACB indexes (K<6) which provide the highest values of the match function $$\tilde{M}_i=(\tilde{w},\tilde{f}_i)^2/(\tilde{f}_i,\tilde{f}_i) \qquad \text{(equation 18)}$$

Only one filtering of the whole content of ACB and K filterings of ACB excitation vectors corresponding to the chosen K indexes in the fast search mode instead of $M_A$ filterings of ACB excitation vectors in the complete search mode are needed. Additional advantages in simplification are achieved from processing the Q-ary quantized instead real valued vectors. The simplest binary {−1,+1} quantization gives the fastest ACB index search without a significant loss of the long term prediction performances. The weighting unit 514 is used in the fast search mode to exclude the first components of QACB vectors influenced by the previous excitation. In the case of the binary {−1, +1} quantization the binary {0,1} weighting may be of use.

Figure 6:
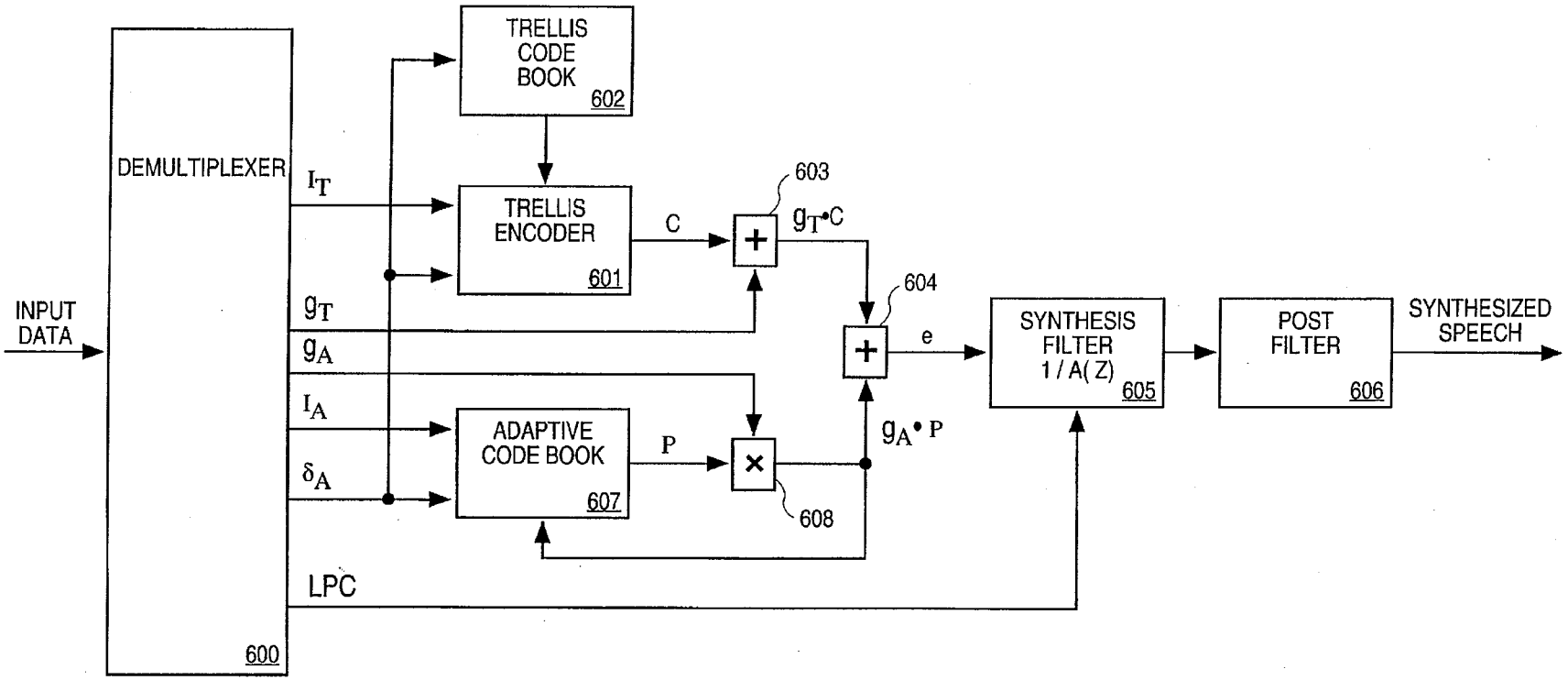
FIG. 6 is a block diagram of a TELP speech synthesizer of the currently preferred embodiment of the present invention.

The block diagram in FIG. 6 shows the implementation of the Trellis Encoding and Linear Prediction (TELP) speech synthesizer. The structure of a synthesizer corresponds to that of the analyzer. Input data is passed through a demultiplexer 600 to obtain a set of linear prediction coefficients as well as trellis parameters $I_T$, $g_T$, and adaptive code book parameters $I_A$, $g_A$ for a given frame. An adaptive code book (ACB) 607 addressed by the ACB index $I_A$ produces the excitation vector p which being multiplied in a multiplier 608 by the ACB gain $g_A$, is transformed into the scaled ACB excitation vector $g_A \cdot p$. A trellis encoder 601 transforms the trellis index $I_T$ into a trellis code word c, a multiplier 603 multiplies c by the trellis gain $g_T$ and an adder 604 adds the scaled trellis code vector $g_T \cdot c$ with the scaled ACB excitation vector to produce the excitation vector $e=g_T \cdot c+g_A \cdot P$ for the processed subframe. The excitation vector e is transformed into the synthesized speech vector by a synthesis filter 605. This vector is also used for updating the content of the adaptive code book 607. If the pre-filter 200 is used in the speech analyzer then the postfiltering of the synthesized speech vector by the filter 606 is performed. The optional parameter $\delta_A$ is used for the selection of one of two trellises with different code rates stored in the trellis code book 602.

Performance and Memory Savings Benefits of Trellis Coding

Trellis Exalted Linear Predictive (TELP) speech coding provides an essential decrease of decoding time and complexity in comparison with known CELP techniques. Further, the memory requirements for the code book are significantly reduced. Most importantly TELP provides the quality of synthesized speech which is good enough for practical usage.

Table A provides a comparison between CELP and TELP in terms of the number of MACs (multiplication-accumulation operations) for a subframe in parallel for the following parameters: frame length N=240, subframe length L=40, filter order m=10, stochastic and trellis code size $V_S=V_T=1024$. Additional parameters for the trellis code are: the edge length n=4, number of states M=8, number of edges incoming to each state q=2. Further a comparison of memory need to store a code book in the respective technique is provided.

TABLE A

CELP/TELP COMPARISON

| Coding technique | Memory size (bits) for storing the code book | Computational complexity (MAC's per subframe) |
|---|---|---|
| CELP | $L*\log_2 V_s=40*10=400$ | $L*(m+2) * \log_2 V_s+2*V_s=6824$ |
| TELP | $M*q*n=8*2*4=64$ | $m*L+2*q*M*(n+1)/n=1680$ |

Referring to Table A, it is shown that the TELP technique will require less than twenty-five percent of the MAC operations required by CELP with a stochastic code book. Clearly, TELP provides a significant performance increase for speech coding. Further, the storage needed to store the code book is approximately sixteen percent of what is required by CELP.

We claim:

1. A trellis excited linear predictive coder for processing digital speech signals partitioned into frames of a first predetermined length, where each frame is partitioned into subframes of a second predetermined length and each subframe is partitioned into a third predetermined number of subblocks, each of said subblocks of a fourth predetermined length, said coder comprising:

a linear predictive analyzer responsive to a speech signal, said linear predictive analyzer for generating frame linear prediction parameters, said frame linear prediction parameters characterizing the short-time speech signal spectrum for successive frames;

interpolation means for interpolating said frame linear prediction parameters to produce subframe linear prediction parameters for successive subframes of a frame;

ringing removal and perceptual weighting means for ringing removal and perceptual weighting said speech signals to produce predistorted speech vectors for successive subframes;

a long term prediction analyzer means coupled to said ringing removal and perceptual weighting means to receive said predistorted speech vectors for each of the successive subframes, said long term prediction analyzer means for generating long term prediction parameters and a scaled pitch component for the successive subframes;

pitch removal means for removing scaled pitch components from said predistorted speech vectors to produce decoder input vectors for the successive subframes;

trellis decoder means coupled to said pitch removal means to receive said decoder input vectors, said decoder input vectors partitioned into a succession of speech subblocks, each of said speech subblocks being processed at a corresponding trellis level, said trellis decoder means for generating trellis gain and trellis path indexes for the successive subframes;

a trellis encoder storage for storing a predetermined trellis structure and list of trellis edge subblocks; and a trellis encoder means coupled to said trellis decoder means to receive said trellis path indexes, said trellis encoder means for generating trellis code words for the successive subframes according to said predetermined trellis structure and the list of trellis edge subblocks stored in said trellis encoder storage.

2. A trellis excited linear predictive coder as recited in claim 1, wherein said trellis decoder means is further comprised of:

edge response generator means for generating decoder synthesis filter responses for said trellis edge subblocks at successive trellis levels;

edge energy generating means coupled to said edge response generator means to receive said decoder synthesis filter responses, said edge energy generation means for generating the energy values for edges for the successive trellis levels;

edge correlation generation means coupled to said edge response generator means to receive said decoder synthesis filter responses and said trellis edge subblocks, said edge correlation generation means for generating correlation values for edges of successive trellis levels;

edge energy accumulator means coupled to said edge energy generating means to receive said energy values for edges, said edge energy accumulator means for accumulating energy values for edges for the successive trellis levels, edge correlation accumulator means coupled to said edge correlation generation means to receive said correlation values for edges, said edge correlation accumulator means for accumulating the correlation values for edges for the successive trellis levels;

arithmetic trellis unit means coupled to said edge energy accumulator means and edge correlation accumulator means to receive said accumulated energy values and said accumulated correlation values, said arithmetic trellis unit means for generating survived transition indexes for trellis states in the successive trellis levels and for generating the trellis gain values for the successive subframes; and path memory means coupled to said arithmetic trellis unit to receive said survived transition indexes, said path memory means for generating the path indexes for the successive subframes.

3. A trellis excited linear predictive coder as recited in claim 2, wherein said edge response generator means is further comprised of:

decoder synthesis filter means coupled to said trellis encoder storage for receiving said trellis edges subblocks, said decoder synthesis filter means for generating edge response vectors for the successive subframes;

edge response memory means for storing said edge response vectors for the successive subframes;

path response memory means for storing the path response vectors for each trellis state wherein each of said path response vectors is generated from a previously stored vector from the path response memory and a vector from the edge response memory; and addition means coupled to said edge response memory and said path response memory to receive said path response vectors and said edge response vectors, said addition means for generating decoder synthesis filter responses for the successive trellis levels.

4. A trellis excited linear predictive coder as recited in claim 1, wherein said long term prediction analyzer means is further comprised of:

adaptive code book (ACB) storage means for storing a plurality of ACB entries;

ACB index generation means for generating a list of ACB indexes for each of the successive subframes;

ACB means coupled to said ACB index generation means to receive said ACB indexes, said ACB means for generating ACB excitation vectors for said ACB indexes, said ACB excitation vectors produced from an entry of said ACB storage, said ACB storage means updated by the excitation vectors for the successive subframes;

a first perceptual synthesis filtering (PSF) means coupled to said ACB means to receive said ACB excitation vectors, said first PSF means for producing filtered vectors for the successive subframes;

ACB subframe energy calculation means coupled to said first PSF means to receive said filtered vectors, said ACB subframe energy calculation means for calculating energy values for said filtered vectors;

ACB subframe correlation calculation means coupled to said first PSF means and said ringing removal and perceptual weighting means to receive said filtered vectors and said predistorted speech vectors, said ACB subframe correlation calculation means for calculating correlation values for said filtered vectors;

ACB arithmetic unit means coupled to said ACB subframe energy calculation means said ACB subframe correlation calculation means and said ACB index generation means to receive energy values, correlation values for said filtered vectors and a list of ACB indexes, said ACB arithmetic unit means for computing ACB indexes and ACB gain values for the successive subframes; and ACB output buffer means for outputting ACB excitation vectors related to said ACB indexes for the successive subframes.

5. A trellis excited linear-predictive coder as recited in claim 4, wherein said ACB index generator means is further comprised of:

a second perceptual synthesis filter (PSF) means coupled to said ACB means to receive said ACB contents, said second PSF means for producing a filtered ACB sequence for each of the successive subframes;

first quantizing means coupled to said second PSF means to receive a first filtered ACB sequence, said quantizing means for producing a quantized filtered ACB sequence for each of the successive subframes;

Q-ary adaptive code book (QACB) means coupled to said first quantizing means, said QACB means for generating QACB vectors for said ACB indexes wherein said QACB vectors are generated from said quantized filtered ACB sequence for each of the successive frames;

weighting means to said QACB means to receive QACB vectors, said weighting means for generating weighted QACB vectors for the successive subframes;

second quantizing means coupled to said ringing removal and perceptual weighting means to receive said predistorted speech vectors, said second quantizing means for computing quantized predistorted speech vectors for the successive subframes;

quantized energy calculation means coupled to said weighting means to receive said weighted QACB vectors, said quantized energy calculation means for computing quantized energy values for QACB vectors for each of the successive subframes;

quantized correlation calculation means coupled to said weighting means and said second quantizing means to receive said weighted QACB vectors and said quantized predistorted speech vectors, said quantized correlation calculation means for computing quantized correlation values for QACB vectors for each of the successive subframes;

QACB arithmetic unit means coupled to said quantized energy calculation means and said quantized correlation calculation means to receive said quantized correlation values and quantized energy values for QACB vectors, said QACB arithmetic unit means for computing said lists of ACB indexes for the successive subframes; and index memory means for generation of said lists of ACB indexes for the successive subframes.

6. A trellis excited linear predictive coder as recited in claim 4 further comprising:

ACB arithmetic unit means for evaluating an ACB efficiency parameter for the successive subframes; and a long term prediction analyzer and trellis decoder adjustment means coupled to said ACB arithmetic unit means to receive said ACB efficiency parameter, said long term prediction analyzer and trellis decoder adjustment means for analyzing and adjusting said speech coder performance.

7. A trellis excited linear predictive coding method for processing digital speech signals, said digital speech signals partitioned into frames of a first predetermined length, each frame partitioned into subframes of a second predetermined length, each subframe partitioned into a third predetermined number of subblocks of a fourth length, said method comprising the steps of:

(a) performing a linear predictive analysis of an input digital speech signal to create frame linear prediction parameters characterizing the short-time speech signal spectrum for successive frames;

(b) interpolating said frame linear prediction parameters to create subframe linear prediction parameters for successive subframes;

(c) generating predistorted speech vectors for each of the successive subframes of said input digital speech signal;

(d) performing long term prediction analysis of said predistorted speech vector for determination of long term prediction parameters and for generating a scaled pitch component for each of the successive subframes;

(e) removing the scaled pitch component from said predistorted speech vector to produce decoder input vector u for each of the successive subframes;

(f) trellis decoding said decoder input vector, said decoder input vector partitioned into a succession of speech subblocks $u=(u_1, u_2, \ldots, u_t, \ldots, u_l)$, where the speech subblock $u_t, 1<t<l$, is processed at the trellis level t, for generating trellis gain $g_T$ and trellis path index $I_T$ for each of the successive subframes;

(g) said $g_t$ and $I_t$ identifying an excitation vector which is being used as an excitation for the decoder synthesis filter (DSF) and which produces a synthesized vector approximating in a predefined sense decoder input vector u; and (h) trellis encoding said trellis path index for generating a trellis code word for each of the successive subframes according to a predetermined trellis structure and a list of trellis edge subblocks stored in a trellis code book.

8. A trellis decoding method for decoding coded speech signals encoded using the method recited in claim 7, said decoding method comprising the steps of:

(a) initializing at the level 0, the values used for trellis decoding, including the DSF memory and values of accumulated correlation $AC_{o,s}$ and accumulated energy $AE_{o,s}$ for each trellis state s, $1<s<M$;

(b) performing a trellis search for given input vector; $u=(u_1, u_2, \ldots, u_t, \ldots, u_l)$ at successive level 1,2, . . . , l, wherein said trellis search at the level t comprising the steps of:

(b1) search for each trellis state i, $1<i<M$, the survived edge j for said state i, terminating at said state i, where said survived edge is being taken from a set Edges(t,i), comprising the steps of:

(b2) generating the DSF response $b_j$ for each edge j from the set Edges (t,i), where said DSF response $b_j$ is being generated by using the contents of the filter memory for the initial state s' of said edge j;

(b3) computing the energy value for the edge j;

(b4) computing the correlation value for the edge j;

(b5) computing the survived edge at the state s as an edge j from the set Edges (t,i) for the level t which provides a maximum for a match function based on an accumulated correlation and an accumulated energy for the initial state s' of the edge j;

(c) storing the transition index $I_t$ of the survived edge i in the path memory;

(d) modifying the accumulated correlation and accumulated energy values for each trellis state s, $1<s<M$;

(e) modifying the contents of the DSF memory for the state s, by using the excitation from the edge j survived at a said state s;

(f) determining a survived state s of level l and, by addressing the paths memory, selecting the survived path which is formed by the sequence of survived edges terminating at the survived state s;

(g) computing a trellis path index, $I_T$ identifying said survived path; and (h) computing a trellis gain $g_T$ based on said accumulated correlation and said accumulated energy for a survived state s of level l.

9. A trellis decoding method as recited in claim 8, wherein determining the survived state of level l comprises calculating for each state s of the trellis level a match function and selecting the state s, which provides the maximum value for said match function as the survived state of level l.

10. A trellis excited linear predictive synthesizer for generating synthesized speech signals from a binary stream, said binary stream comprising encoded successive subframes of encoded speech signals, each of said successive subframes including an adaptive code book (ACB) index value, an ACB gain value, a trellis code book index value, a trellis code book gain value and a side information parameter for successive subframes, said trellis excited linear predictive synthesizer comprising:

a parsing means for receiving a binary stream and parsing out component parts of encoded successive subframes;

pitch generation means for generating a scaled ACB pitch excitation signal from said adaptive code book index value, said adaptive code book gain value and side information parameter for successive subframes, trellis code word generation means for generating scaled trellis code words from said trellis code book index value, said trellis code book gain value and said side information parameter;

combining means for combining said scaled trellis code words with said scaled ACB pitch excitation signal to create an excitation vector for a processed subframe; and a linear synthesis filter means coupled to said combining means, said linear synthesis filter means for transforming an excitation vector into a synthesized speech signal.

11. The trellis excited linear productive synthesizer as recited in claim 10 wherein said trellis code word generation means is further comprised of a trellis encoder and a trellis code book.

12. A trellis excited linear predictive coder for processing digital speech signals partitioned into frames of a first predetermined length, where each frame is partitioned into subframes of a second predetermined length and each subframe is partitioned into a third predetermined number of subblocks, each of said subblocks of a fourth predetermined length, said coder comprising:

a linear predictive analyzer responsive to a speech signal, said linear predictive analyzer for generating frame linear prediction parameters, said frame linear prediction parameters characterizing the short-time speech signal spectrum for successive frames;

an interpolation module configured to interpolate said frame linear prediction parameters to produce subframe linear prediction parameters for successive subframes of a frame;

a ringing removal and perceptual weighting unit configured to produce predistorted speech vectors for successive subframes;

a long term prediction analyzer coupled to said ringing removal and perceptual weighting unit to receive said predistorted speech vectors for each of the successive subframes, said long term prediction analyzer for generating long term prediction parameters and a scaled pitch component for the successive subframes;

a feedback loop configured to remove scaled pitch components from said predistorted speech vectors to produce decoder input vectors for the successive subframes;

a trellis decoder for generating trellis gain and trellis path indexes for the successive subframes, said trellis decoder coupled to said feedback loop to receive said decoder input vectors, said decoder input vectors partitioned into a succession of speech subblocks, each of said speech subblocks being processed at a corresponding trellis level;

a trellis encoder storage having stored therein a predetermined trellis structure and list of trellis edge subblocks; and a trellis encoder coupled to said trellis decoder to receive said trellis path indexes, said trellis encoder for generating trellis code words for the successive subframes according to said predetermined trellis structure and the list of trellis edge subblocks.

13. A trellis excited linear predictive coder as recited in claim 12, wherein said trellis decoder is further comprised of:

an edge response generator configured to generate decoder synthesis filter responses for said trellis edge subblocks at successive trellis levels;

an edge energy unit coupled to said edge response generator to receive said decoder synthesis filter responses, said edge energy unit configured to generate the energy values for edges for the successive trellis levels;

an edge correlation unit coupled to said edge response generator to receive said decoder synthesis filter responses and said trellis edge subblocks, said edge correlation unit configured to produce correlation values for edges of successive trellis levels;

an edge energy accumulator coupled to said edge energy unit to receive said energy values for edges, said edge energy accumulator for accumulating energy values for edges for the successive trellis levels, an edge correlation accumulator coupled to said edge correlation unit to receive said correlation values for edges, said edge correlation accumulator for accumulating the correlation values for edges for the successive trellis levels;

an arithmetic trellis unit coupled to said edge energy accumulator and edge correlation accumulator to receive said accumulated energy values and said accumulated correlation values, said arithmetic trellis unit configured to generate survived transition indexes for trellis states in the successive trellis levels and for generating the trellis gain values for the successive subframes; and a path memory unit coupled to said arithmetic trellis unit to receive said survived transition indexes, said path memory unit configured to output the path indexes for the successive subframes.

14. A trellis excited linear predictive coder as recited in claim 12, wherein said long term prediction analyzer is further comprised of:

an adaptive code book (ACB) storage for storing a plurality of ACB entries;

an ACB index generator configured to generate a list of ACB indexes for each of the successive subframes;

an ACB coupled to said ACB index generator to receive said ACB indexes, said ACB configured to produce ACB excitation vectors for said ACB indexes, said ACB excitation vectors produced from an entry of said ACB storage, said ACB storage updated by the excitation vectors for the successive subframes;

a first perceptual synthesis filter (PSF) coupled to said ACB to receive said ACB excitation vectors, said first PSF for producing filtered vectors for the successive subframes;

an ACB subframe energy calculation unit coupled to said first PSF to receive said filtered vectors, said ACB subframe energy calculation unit for calculating energy values for said faltered vectors;

an ACB subframe correlation calculation unit coupled to said first PSF and said feedback loop to receive said filtered vectors and said predistorted speech vectors, said ACB subframe correlation calculation unit for calculating correlation values for said filtered vectors;

an ACB arithmetic unit coupled to said ACB subframe energy calculation unit said ACB subframe correlation calculation unit and said ACB index generator to receive energy values, correlation values for said filtered vectors and a list of ACB indexes, said ACB arithmetic unit for computing ACB indexes and ACB gain values for the successive subframes; and an ACB output buffer for outputting ACB excitation vectors related to said ACB indexes for the successive subframes.

15. A trellis excited linear predictive coder as recited in claim 14 further comprising:

a long term prediction analyzer and trellis decoder adjustment unit coupled to said ACB arithmetic unit to receive an efficiency parameter, said long term prediction analyzer and trellis decoder adjustment unit for analyzing and adjusting said speech coder performance; wherein said ACB arithmetic unit evaluates said efficiency parameter for the successive subframes.

16. A trellis excited linear predictive synthesizer for generating synthesized speech signals from a binary stream, said binary stream comprising encoded successive subframes of encoded speech signals, each of said successive subframes including an adaptive code book (ACB) index value, an ACB gain value, a trellis code book index value, a trellis code book gain value and a side information parameter for successive subframes, said trellis excited linear predictive synthesizer comprising:

a parsing unit configured to receive a binary stream, said parsing unit parsing out component parts of encoded successive subframes;

a pitch generator configured to produce a scaled ACB pitch excitation signal from said ACB index value, said ACB gain value and said side information parameter for successive subframes, a trellis code word unit configured to generate scaled trellis code words from said trellis code book index value, said trellis code book gain value and said side information parameter;

a combination unit for combining said scaled trellis code words with said scaled ACB pitch excitation signal to create an excitation vector for a processed subframe; and a linear synthesis filter coupled to said combination unit, said linear synthesis filter configured to transform an excitation vector into a synthesized speech signal.

17. The trellis excited linear productive synthesizer as recited in claim 16 wherein said trellis code word unit is further comprised of a trellis encoder and a trellis code book.

* * * * *

UNITED STATES PATENT AND TRADEMARK OFFICE

CERTIFICATE OF CORRECTION

PATENT NO. : 5,659,659

DATED : August 19, 1997

INVENTOR(S) : Kolesnik et al.

It is certified that error appears in the above-identified patent and that said Letters Patent is hereby corrected as shown below:

In column 2 at line 63 delete "flames" and insert --frames--

In column 2 at line 64 delete "flame: " and insert --frame--

In column 11 at line 13 delete "Exalted" and insert --Excited--

Signed and Sealed this

Twenty-seventh Day of January, 1998

Bruce Lehman

*Attest:*

BRUCE LEHMAN

*Attesting Officer*

*Commissioner of Patents and Trademarks*